United States Patent [19]

Crocker

[11] 4,150,446

[45] Apr. 24, 1979

[54] TOILET SEAT LIFTER

[76] Inventor: James E. Crocker, Rte. 3, Box 80, Windsor, Va. 23487

[21] Appl. No.: 858,256

[22] Filed: Dec. 7, 1977

[51] Int. Cl.[2] ..... A47K 3/10

[52] U.S. Cl. ..... 4/251; 4/144; 4/238; 4/272

[58] Field of Search ..... 4/251, 144, 136, 138, 4/272

[56] References Cited

U.S. PATENT DOCUMENTS

| | | | |
|---|---|---|---|
| 428,001 | 5/1890 | Kaley | 4/251 |
| 1,664,426 | 4/1928 | Lang | 4/144 |
| 1,999,971 | 4/1935 | Williamson | 4/251 |
| 2,088,050 | 7/1937 | Brown | 4/251 |
| 2,136,489 | 11/1938 | Campbell et al. | 4/144 |
| 2,155,548 | 4/1939 | Hompesch | 4/251 |
| 2,661,484 | 12/1953 | Jung | 4/251 |
| 2,723,400 | 11/1955 | Wilson | 4/251 |

FOREIGN PATENT DOCUMENTS

| | | | |
|---|---|---|---|
| 72094 | 11/1893 | Fed. Rep. of Germany | 4/251 |
| 375111 | 9/1939 | Italy | 4/272 |
| 294108 | 3/1972 | Italy | 4/272 |
| 153415 | 8/1953 | Netherlands | 4/251 |
| 16354 | 10/1906 | Norway | 4/272 |

*Primary Examiner*—Henry K. Artis
*Attorney, Agent, or Firm*—Howard I. Podell

[57] ABSTRACT

A foot controlled toilet seat lifter which includes a "V" shaped lever pivoted near its middle point on a base and having a pedal at one end and an eye at the other. A cable trained on a pulley secured to the base has one end fixed inside a threaded sleeve passing through the eye and adjustable thereon by means of a nut to adjust tension on the cable with its other end adjustably secured to a trip lever fixed to the hinge pin of the seat.

3 Claims, 5 Drawing Figures

TOILET SEAT LIFTER

FIELD OF THE INVENTION

This invention relates generally to a foot operated lifting device for toilet seats.

DESCRIPTION OF THE PRIOR ART

The prior art, as exemplified by U.S. Pat. Nos. 4,007,499; 3,516,095; 3,055,016 and 2,155,548 is generally illustrative of various devices of this type. While such devices are generally acceptable for their intended purpose they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a foot controlled toilet seat lifter which includes a "V" shaped lever pivoted near its middle point on a base and having a pedal at one end and an eye at the other. A cable trained on a pulley secured to the base has one end fixed inside a threaded sleeve passing through the eye and adjustable thereon by means of a nut to adjust tension on the cable with its other end adjustably secured to a trip lever fixed to the hinge pin of the seat.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
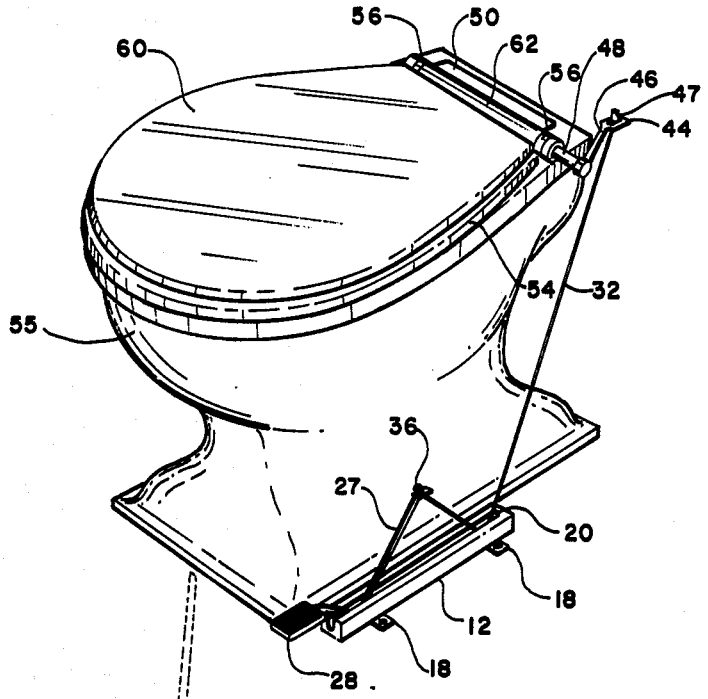
FIG. 1 is a view in perspective of a device embodying the present invention connected to a conventional toilet.

With reference to the drawing, there is shown and illustrated a toilet seat lifter constructed in accordance with the principles of the invention and designated generally by reference character 10. The illustrated tangible embodiment of the invention includes a box-like base 12 secured to the floor adjacent the toilet 16 by bolts or screws 18. An elongated slot 26 extending therethrough and terminating at the front wall 22 of the base. A pair of pivot posts 24 are fixed inside the base and support pivot 26 on which "V" shaped lever 27 is pivoted. The forward end of the lever 26 is equipped with a pedal 28 suitably shaped to receive a human foot. The back end of the lever is formed with a horizontally extending eye 30.

Figure 5:
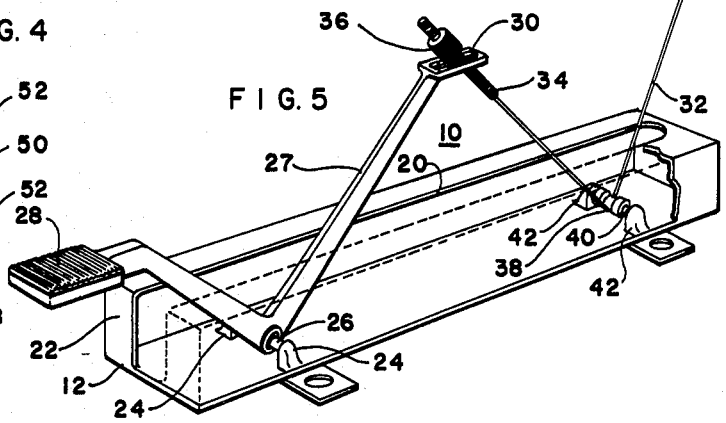
FIG. 5 is a perspective view of the device detached.

As shown in FIG. 5, a cable 32 has one end fixed in a threaded sleeve 34 which passes through eye 30 and is loosely received therein. A set screw 36 is threaded over sleeve to adjust the tension on cable 32. A pulley 38 is journalled on shaft 40 supported between brackets 42 in housing 12.

Figure 4:
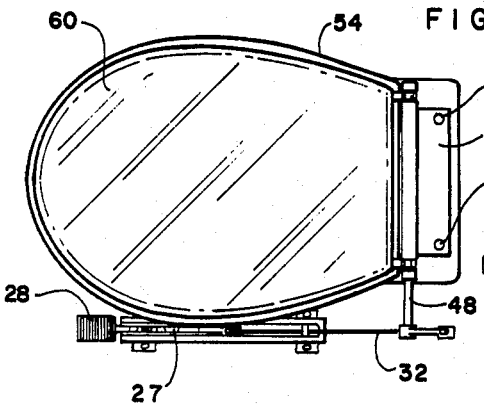
FIG. 4 is a top planar view of same.

Cable 32 is trained under pulley 38 and terminates outside opening 44 in the outer end of angle bracket 46 to which it is secured by stop 47. The inner end of bracket 46 is secured to one end of hinge pin 48 rotatably mounted in hinge 50 secured by screws 52. Seat 54 is rigidly secured to pin 48 over bowl 55 by means of fixed bearings 56 fitting thereon at one end thereof. The other end of bearings 56 are secured by screws 58 to the sides of the seat 54 (FIG. 4).

A toilet cover 60 is hinged by hinge 62 to pin 48 which lies between bearings 56.

Figure 2:
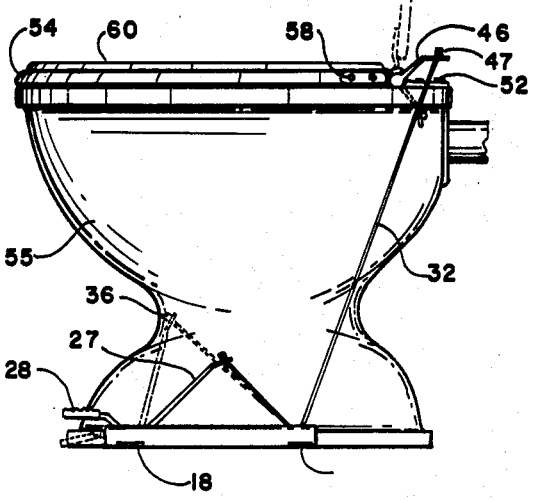
FIG. 2 is a side elevational view of the device and toilet shown in FIG. 1 with the toilet seat shown in raised and lowered positions.
Figure 3:
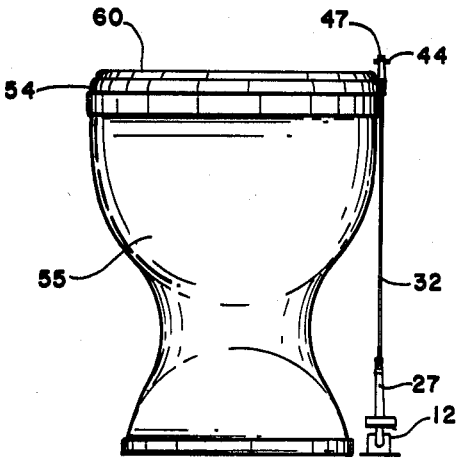
FIG. 3 is a front elevation of the system.

When it is desired to use the apparatus of the present invention, the user presses his foot downwardly on foot pedal 28. This downward pressure on the foot pedal 28 causes lever 27 to pivot on pivot 26 which action raises the opposite end of lever 26. In turn, this pulls cable 32 down causing it to pull down on bracket 46 thus raising seat 54 and with it toilet cover 60. As shown by dotted lines in FIG. 2.

The invention provides greater hygiene and is helpful to disabled persons.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. In combination with a toilet bowl a toilet seat lifter comprising, a hinge secured thereto, a pin passing therethrough, a seat secured to said pin and movable therewith; a toilet cover hinged to said pin; a foot lever pivotally mounted at the base of said bowl; a cable connected to one end of said foot lever and extending upwardly to said pin and being secured to one end of a bracket fixed on one end of said pin whereby downward pressure on said foot lever lowers said bracket thereby turning said pin and raising said seat and said toilet cover, further including a housing secured at the base of said bowl and having an elongated slot in the upper part thereof receiving said foot lever therein; and a pulley in said housing, said cable being trained thereunder.

2. The invention as recited in claim 1, wherein said foot lever is generally "V" shaped and pivoted between its ends; said lever having a pedal at its front end and an eye at its other end.

3. The invention as recited in claim 2, wherein said cable has one end fixed in a threaded sleeve; said sleeve fitting in said eye and having tensioning means thereon.

* * * * *